US011427290B2

(12) United States Patent
Scheck

(10) Patent No.: US 11,427,290 B2
(45) Date of Patent: Aug. 30, 2022

(54) ANCHOR RESCUE SYSTEM

(71) Applicant: Mike Scheck, San Leandro, CA (US)

(72) Inventor: Mike Scheck, San Leandro, CA (US)

( * ) Notice: Subject to any disclaimer, the term of this patent is extended or adjusted under 35 U.S.C. 154(b) by 0 days.

(21) Appl. No.: 17/460,202

(22) Filed: Aug. 28, 2021

(65) Prior Publication Data

US 2021/0387707 A1 Dec. 16, 2021

Related U.S. Application Data

(60) Provisional application No. 63/072,438, filed on Aug. 31, 2020.

(51) Int. Cl.

| | |
|---|---|
| ***B63B 21/46*** | (2006.01) |
| ***B63C 7/16*** | (2006.01) |
| *B63B 21/24* | (2006.01) |

(52) U.S. Cl.
CPC ..... *B63C 7/16* (2013.01); *B63B 21/46* (2013.01); *B63B 2021/246* (2013.01)

(58) Field of Classification Search
CPC ..... B63C 7/16; B63B 21/46; B63B 2021/246
See application file for complete search history.

(56) References Cited

U.S. PATENT DOCUMENTS

| | | | | |
|---|---|---|---|---|
| 2,816,522 | A | 12/1957 | Root | |
| 3,150,629 | A | 9/1964 | Fields | |
| 4,836,126 | A * | 6/1989 | Kobayashi | B63B 21/22 114/297 |
| 6,009,826 | A * | 1/2000 | Nole | B63B 21/46 114/299 |
| 6,209,475 | B1 * | 4/2001 | Powell | B63B 21/22 114/299 |
| 7,886,681 | B2 | 2/2011 | Weinstein et al. | |
| 10,822,057 | B1 * | 11/2020 | Mendes | B63B 21/32 |
| 2010/0050918 | A1 * | 3/2010 | Provonchee | B63B 21/22 114/210 |
| 2020/0050918 | A1 | 2/2020 | Chen et al. | |

* cited by examiner

*Primary Examiner* — Andrew Polay
(74) *Attorney, Agent, or Firm* — Steven A. Nielesn; www.NielsenPatents.com

(57) ABSTRACT

An anchor rescue system includes an improved slider assembly 200 and retriever assembly 300 allowing for secure attachment as the retriever assembly is lowered upon an anchor line to attach to the slider assembly. Once attached, the retriever assembly pulls upon the slider assembly with the slider assembly attached to a tether chain 210 with the tether chain attached to a lower portion of the anchor, such as crown, causing the anchor to move upwardly in a relative horizontal position. The system frees trapped anchors without need for floatation devices.

6 Claims, 14 Drawing Sheets

ANCHOR RESCUE SYSTEM

CROSS-REFERENCE TO RELATED APPLICATIONS

This utility application claims the priority date of provisional patent application 63/072,438 filed on Aug. 31, 2020, the contents of which are incorporated as if restated herein.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to anchor retrieval systems. More particularly, the invention relates to means and methods of efficiently changing the pivot point of an anchor as the anchor is raised.

(2) Description of the Related Art

The known related art fails to anticipate or disclose the principles of the present invention.

In the related art, anchors are fouled or otherwise not easily retrievable. A lost anchor at sea has serious consequences.

In the related art, various means of shifting tension from the leading edge of an anchor shank to the crown end of an anchor shank are known. But, the means of shifting tension are unreliably, bulky and difficult to implement. For example, in the prior art, the use of zip ties, twine and other releasable fasteners may be used to initially secure an anchor chain to the leading edge or distal end of an anchor shank. If the anchor become fouled or otherwise stuck, tension at different angles may free the anchor chain from the releasable fasteners, wherein the end of the anchor chain attached to the crown end of the anchor would become the pulling point. While the general idea of having two pulling points upon an anchor is excellent, the prior art implementations leave much to be desired.

U.S. Pat. No. 2,569,006 granted to Illsche on Sep. 18, 1951 discloses a fixed line with the distal end attached to crown of the anchor and a mid-section attached the head of the anchor with the head to mid-section attached via releasable means. In normal operation, the anchor line is fixed at the head of the anchor. When fouled, tension on the anchor line is increased so as to break the attachment point between the line mid-section and anchor head, causing the distal end of the line and boat to be in direct alignment, causing tension at the anchor head section. The direct alignment between the anchor crown section and boat cause the anchor to be urged or pulled directly at the anchor crown section which can cause the lower fouled arm of the anchor to become further entangled in the obstacle or fouling object. This direct pull upon the crown or fluke of the anchor is a shortfall seen in serval other prior art examples.

U.S. Pat. No. 2,816,522 granted to Root on Dec. 17, 1957 shares the sample general principle of operation as seen in Illsche described above. In Root a flexible figure eight pin holds a mid-section of anchor line to the head of the anchor. With abnormal tension, the figure eight pin or ring releases, causing the boat and anchor crown to be in direct alignment, causing the same shortfall described above in Illsche.

U.S. Pat. No. 7,886,681 granted to Weinstein et al on Feb. 15, 2011 uses the same anchor head to line release concept as found in Illsche and Root discussed above.

U.S. Pat. No. 3,150,629 granted to Fields on Sep. 29, 1964 uses a break away fastener at the head of the anchor to release the anchor line, thus causing direct anchor line tension at the anchor crown or anchor fluke as discussed above in Weinstein, Root and Illsche.

US Published Patent Application US2020/0050918 by Provonchee and published on Mar. 5, 2020 does disclose a tether attached to the anchor crown and a slider, with the slider disposed at or near the head of the anchor. A retriever may be slid down the anchor line, with the retriever engaging or fastening to the slider. When the retriever line attached to the retriever is pulled, the anchor crown becomes in direct alignment with the boat, as shown in FIG. 1D in Provonchee. Thus Provonchee has the same prior art problem of direct pulling at the crown or fluke as in Weinstein, Root, Illsche and Fields as discussed above. Also, Provonchee introduces a new prior art shortfall of using a retriever that is prone to fouling and a retriever that is devoid of adequate means of attachment to a slider.

Hence, there is a great need in the art for the present invention.

BRIEF SUMMARY OF THE INVENTION

The present invention overcomes shortfalls in the related art by presenting an unobvious and unique combination and configuration of methods and components to provide an add-on kit to existing anchors to allow the anchors to be pivoted and hence released from entrapment.

The disclosed embodiments may overcome shortfalls in the related art by being made of or comprising stainless steel, comprising stainless shackles, having a design wherein one model or size fits all anchor applications, use of a manufacturing process of two cast components bolted together and may be marketed or sold to fit most anchors.

The disclosed embodiments further overcome shortfalls in the related art by using a sleeve assembly that may comprise both a slider and a sleeve insert that natively lodges at the leading edge of the anchor. The slider may comprise a fixed weld point or other means of attachment to a tether chain with the opposite end of the tether change attached to the crown end of the anchor. During normal use, the slider stays attached to the leading edge of the anchor. But, if the anchor become fouled or stuck, a retriever assembly may be slide down the anchor chain and engage or attached to the slider assembly. Once engaged, the slider assembly rises with the pulling of the anchor change to pull the attached tether chain. The tether chain, attached to the slider assembly and the crown end of the anchor, causes the anchor to pivot or otherwise rise from the crown end and not the leading end. The change in pulling position upon the anchor may cause a pivot of the anchor and/or a more beneficial pulling of the anchor as pulling now occurs at or near anchor blades that may be imbedded into the ocean floor. Moreover, debris, old chains and other anchor catching objects will no longer be positioned between the bottom side of the anchor shank and any anchor blades.

The presently disclosed embodiments further overcome shortfalls in the art by the new and unobvious use of floating shackles, with the shackles having proximal ends pivotally attached to the retriever and the shackles having distal ends capable of fitting into a void of the slider so as to retain the slider in an upward movement, with the upward movement causing the tether chain to raise the fouled anchor at the crown end.

The overall system of how the retriever assembly is able to slide down the anchor chain and then easily and securely capture the slider assembly allows for quick and reliable means of changing the pulling points upon a fouled anchor.

Disclosed embodiments may include the use of artfully secured and positioned cameras to further aid in the placement and retrieval of an anchor.

The disclosed embodiments overcome the shortfalls of Provonchee by use of a superior retriever and slider connection system, a tether to slider connection that results in a more horizontal lifting of the anchor, as shown in FIG. 6 of the present invention.

These and other objects and advantages will be made apparent when considering the following detailed specification when taken in conjunction with the drawings.

REFERENCE NUMERALS IN THE DRAWINGS

Figure 1:
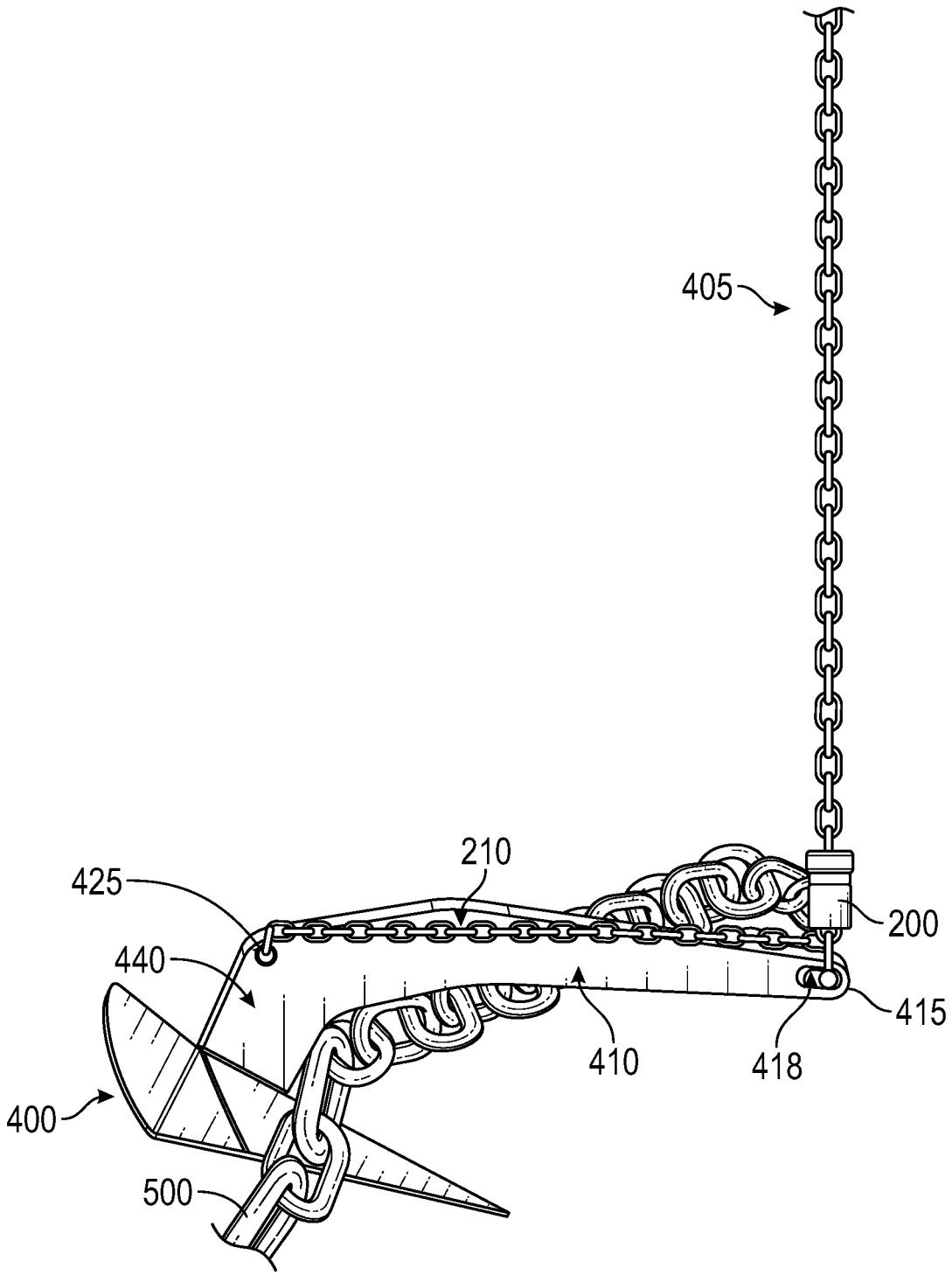
FIG. 1 depicts a fouled anchor

100 overall system
110 system container or marketing box
200 slider assembly
210 tether chain
215 Velcro tie
220 slider
222 superior beveled edge of slider 220
227 retention void defined within the slider 220
230 welded link
240 set screws
260 sleeve insert
270 set screw divots
300 retriever assembly
310 bridle line of retriever assembly
315 retriever
320 ring bracket
322 rope ring
327 slider retention tab
325 retriever shackles or floating retriever shackles
345 retriever gate
347 void defined within retriever gate, sometimes used to mount a camera
355 shoulder bolts
365 gate lock tab
400 anchor
405 anchor chain or anchor rode
410 anchor shank
415 leading edge of anchor shank
418 shank eye void, defined within the anchor shank
425 crown eye void defined within anchor shank
440 crown end of anchor shank
500 object fouling or retaining anchor

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts an anchor 400 fouled or otherwise constrained by debris 500 such as an old chain. A slider assembly 200 is attached at the leading edge 418 of the anchor. The slider assembly may also be attached to a tether 210 or tether chain with the far end of the tether attached to a bottom portion of the anchor, such as the crown end 440 of the anchor shank 410. The far end of the tether may be secured though a crown eye void 425, the crown eye void defined within the anchor shank.

Figure 2:
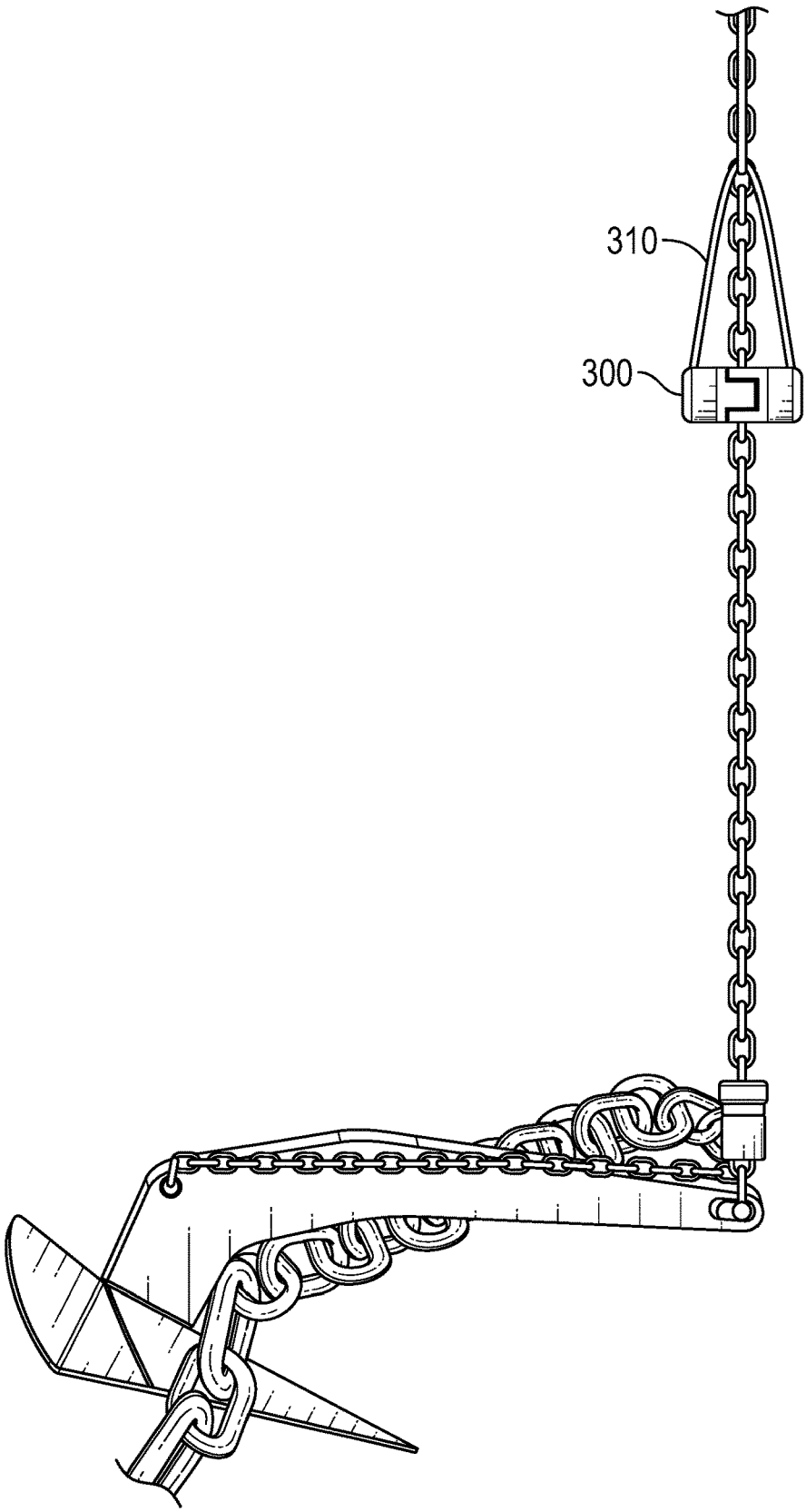
FIG. 2 depicts a retriever assembly being lowered down an anchor chain

FIG. 2 depicts a downward decent of a retriever assembly 300.

Figure 3:
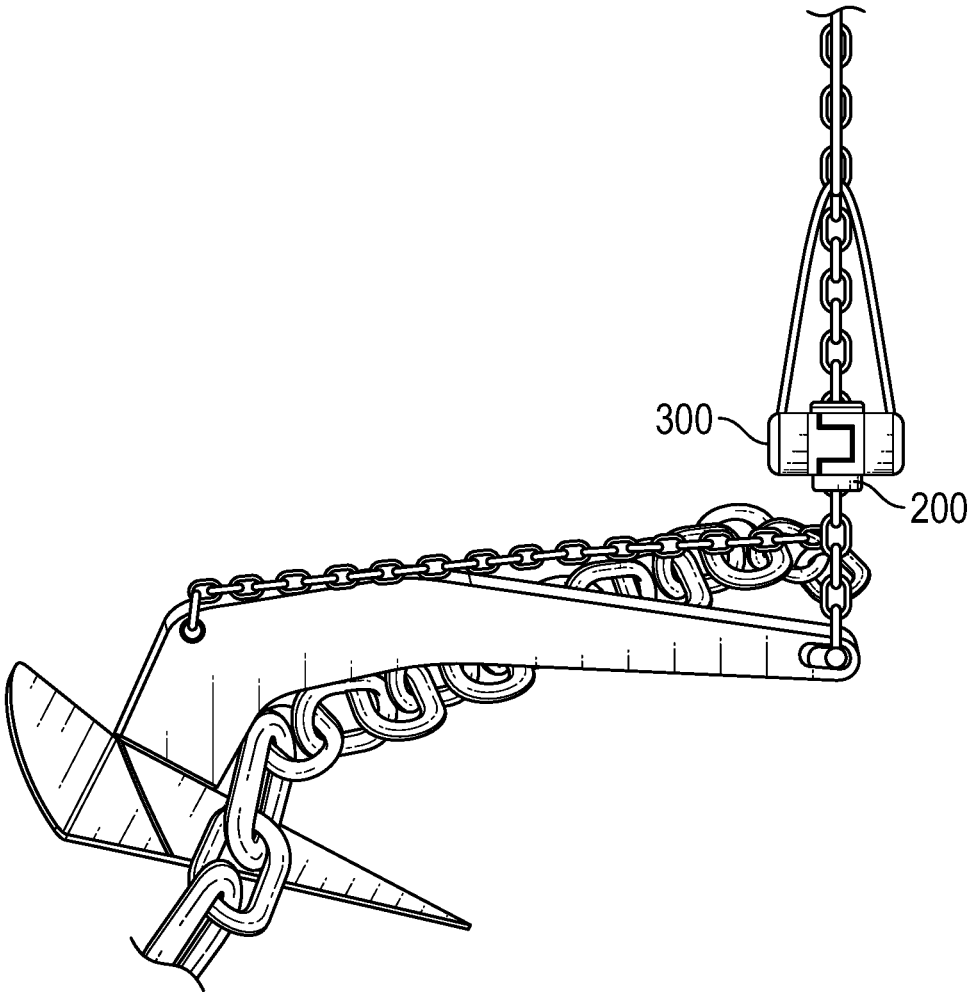
FIG. 3 depicts a retriever assembly engaged with a slider assembly

FIG. 3 depicts a retriever assembly engaged with or otherwise attached to a slider assembly 200.

Figure 4:
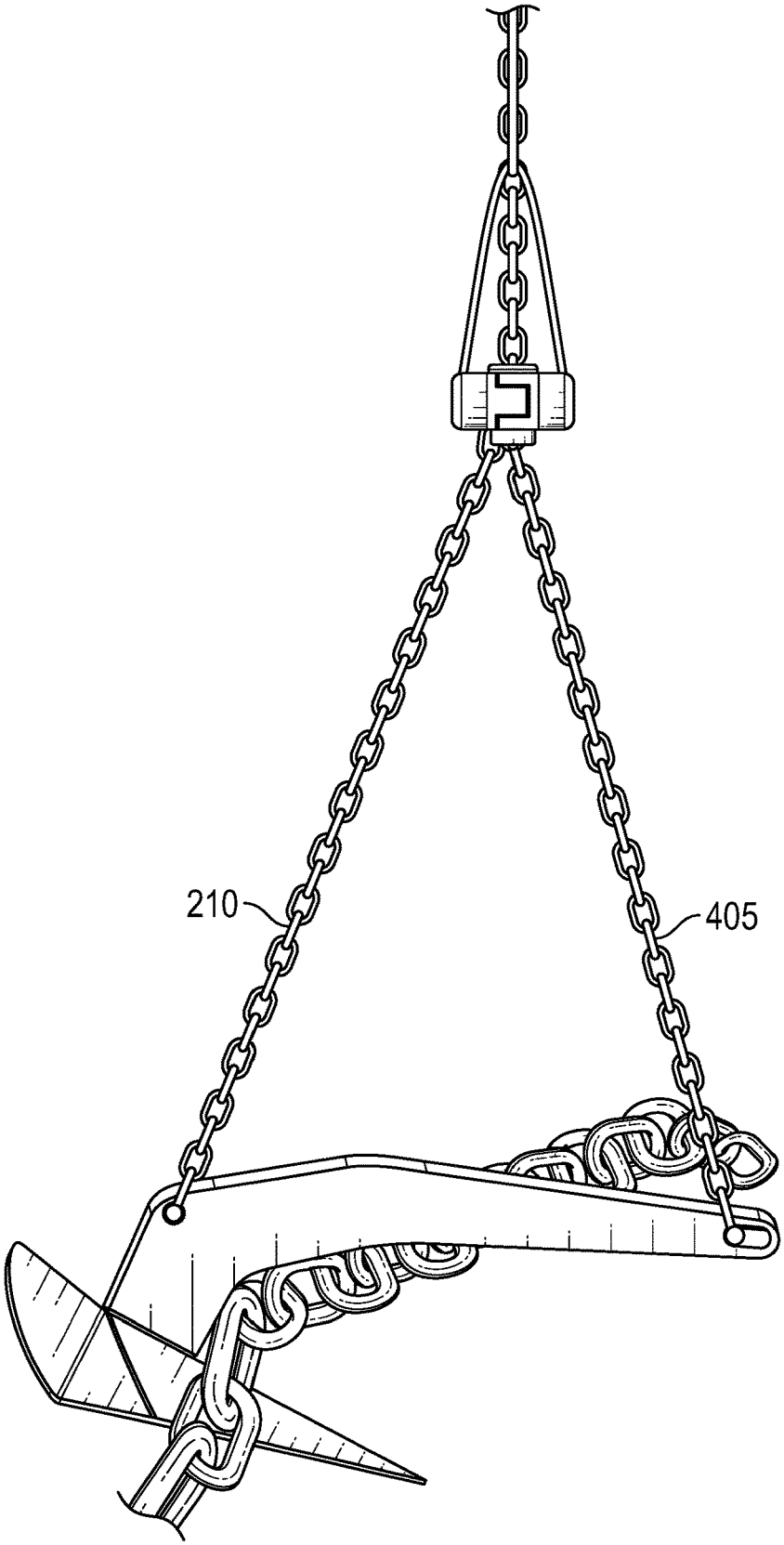
FIG. 4 depicts tension starting to be applied to a tether chain attached to the crown end of an anchor

FIG. 4 depicts the retriever assembly lifting the slider assembly, causing tension in the tether chain 210.

Figure 5:
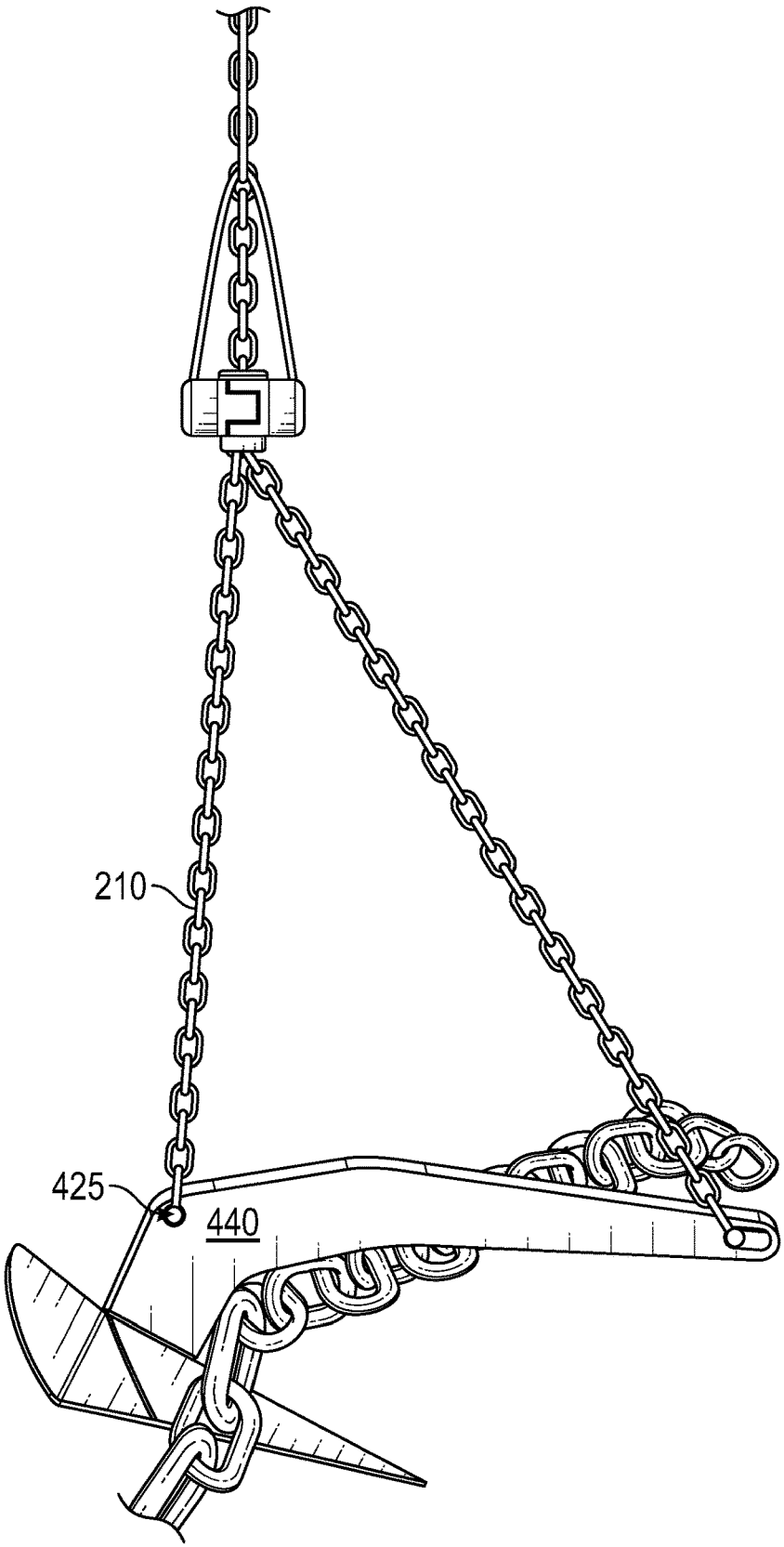
FIG. 5 depicts direct tension applied to crown end of an anchor

FIG. 5 depicts vertical or direct tension upon the tether chain 210 causing the crown end 440 of the anchor to move upwardly, freeing the anchor of the debris. The fouling debris is a old chain.

Figure 6:
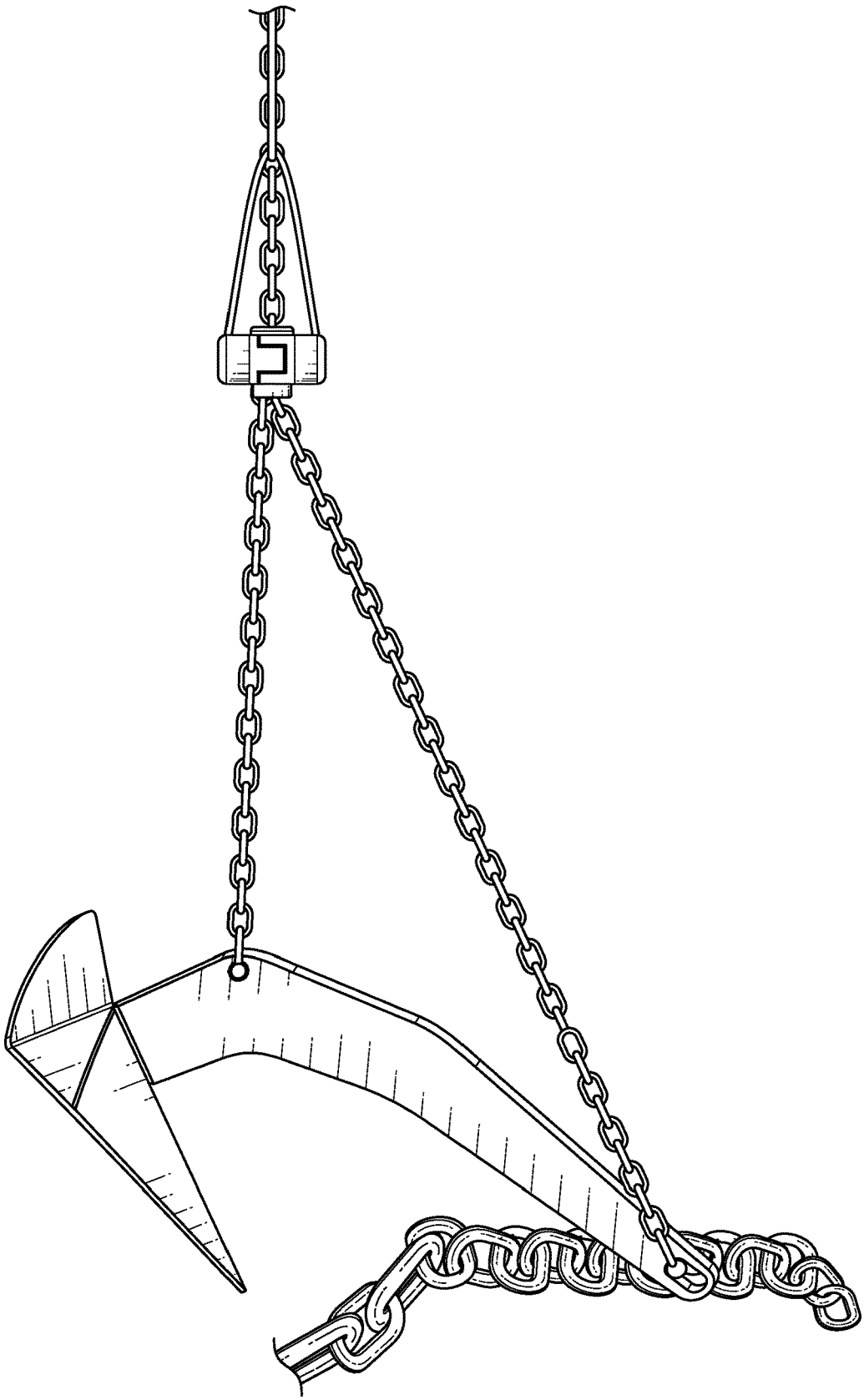
FIG. 6 depicts an anchor being freed by being raised at the crown end

FIG. 6 depicts the anchor being lifted by the crown end by direct tension of the tether line. Note that the angle of the fluke and anchor shank may just be slightly above a horizontal position so as to not further entangle the anchor upon lifting via the tether.

Figure 7:
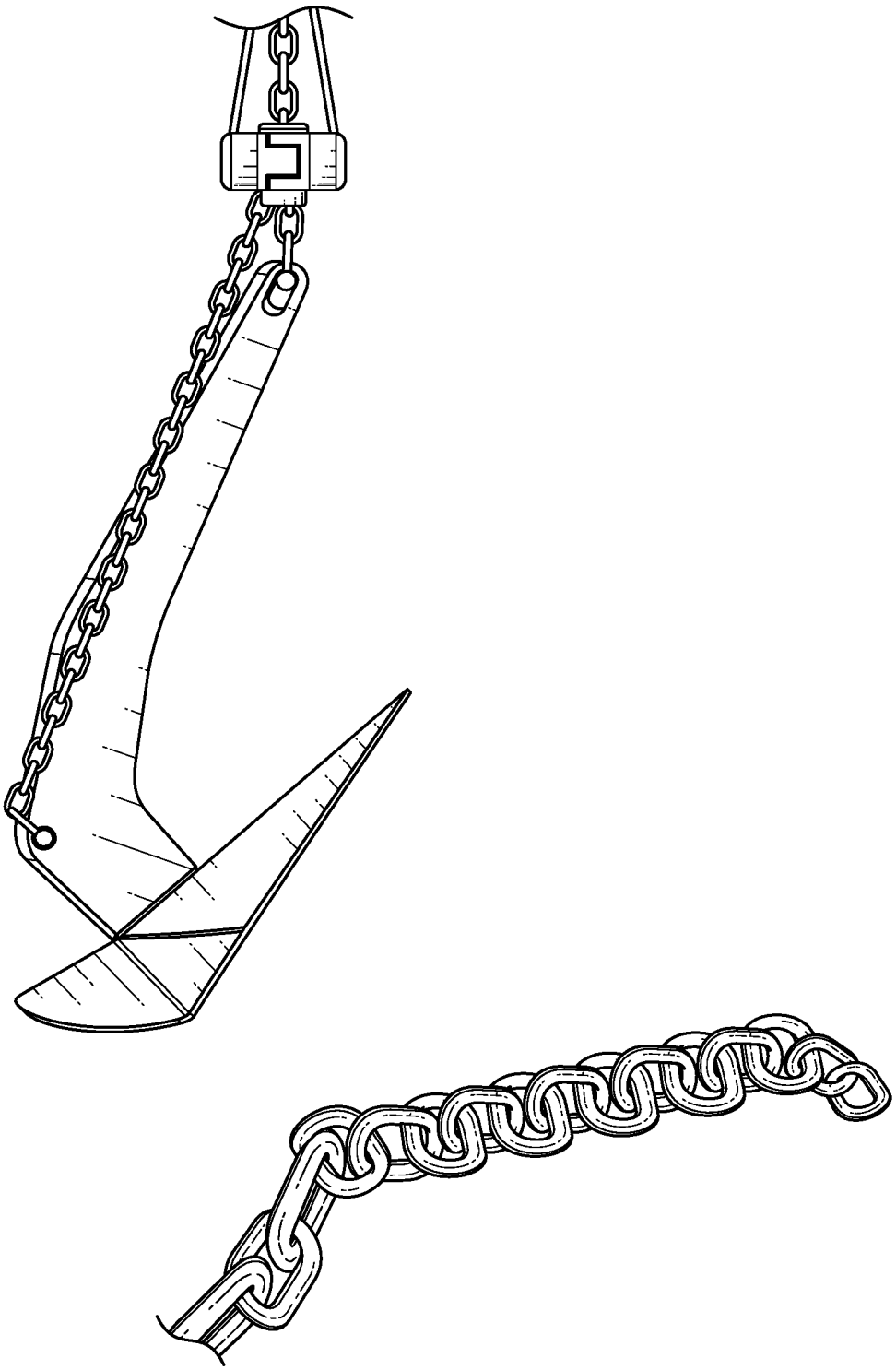
FIG. 7 depicts an anchor being raised back to the ship

FIG. 7 depicts the further movement of the anchor back to the ship.

Figure 8:
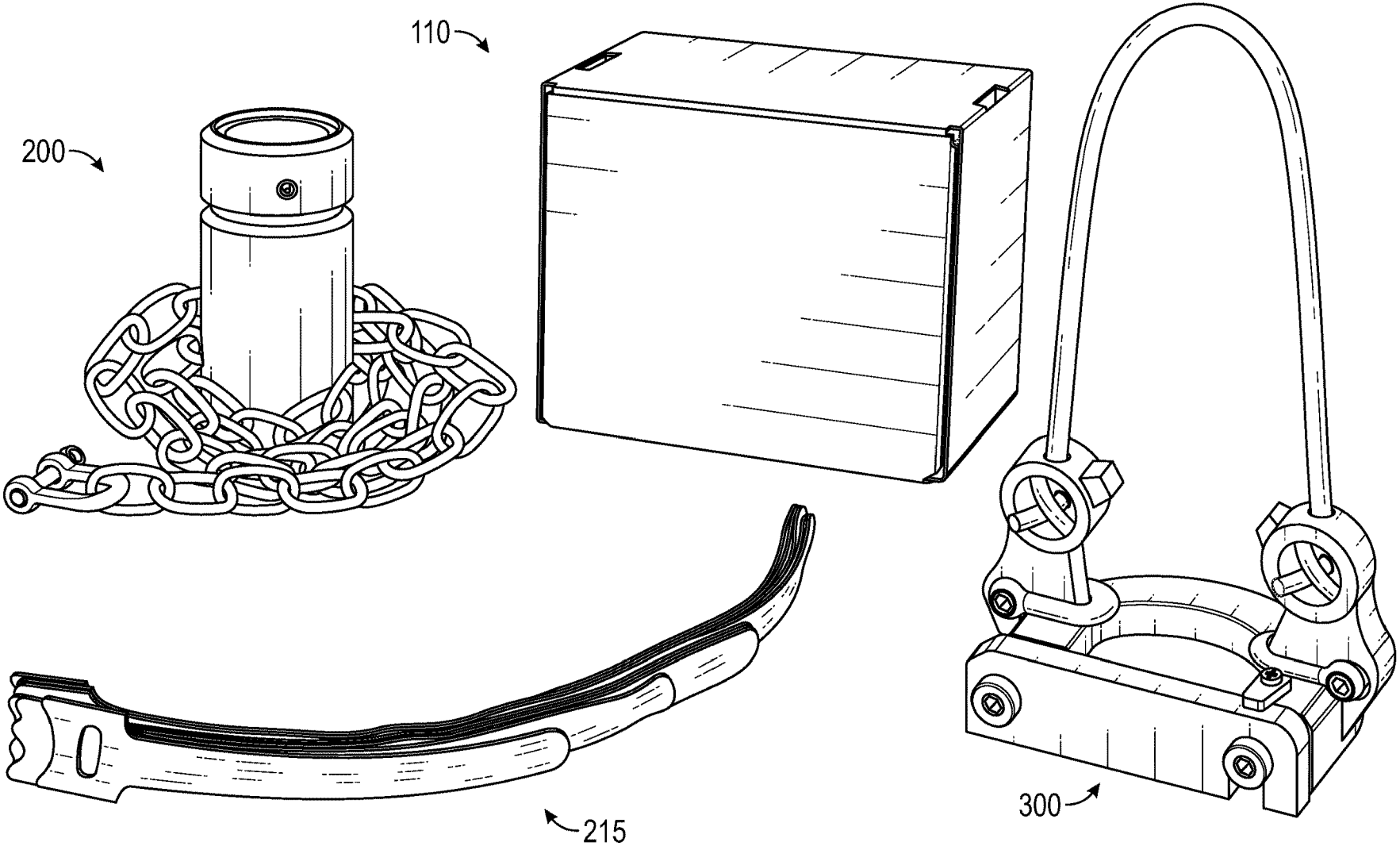
FIG. 8 depicts components of a disclosed embodiment

FIG. 8 depicts a slider assembly 200, marketing box 110, retriever assembly 300 as well as a plurality of Velcro ties or zip ties sometimes used to secure the tether to the anchor before use of a disclosed embodiment.

Figure 9:
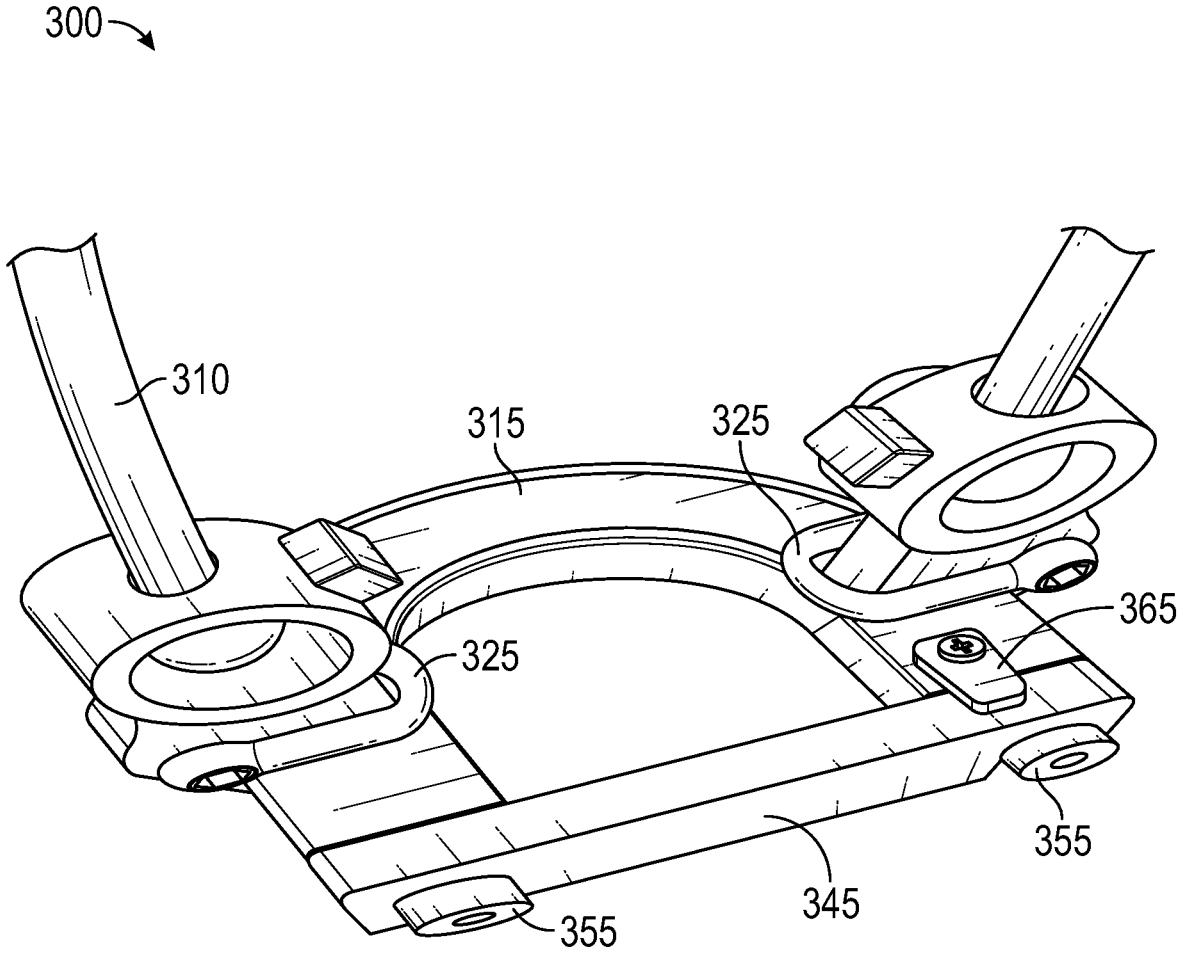
FIG. 9 depicts components of a disclosed retriever assembly

FIG. 9 depicts components of the retriever assembly 300.

Figure 10:
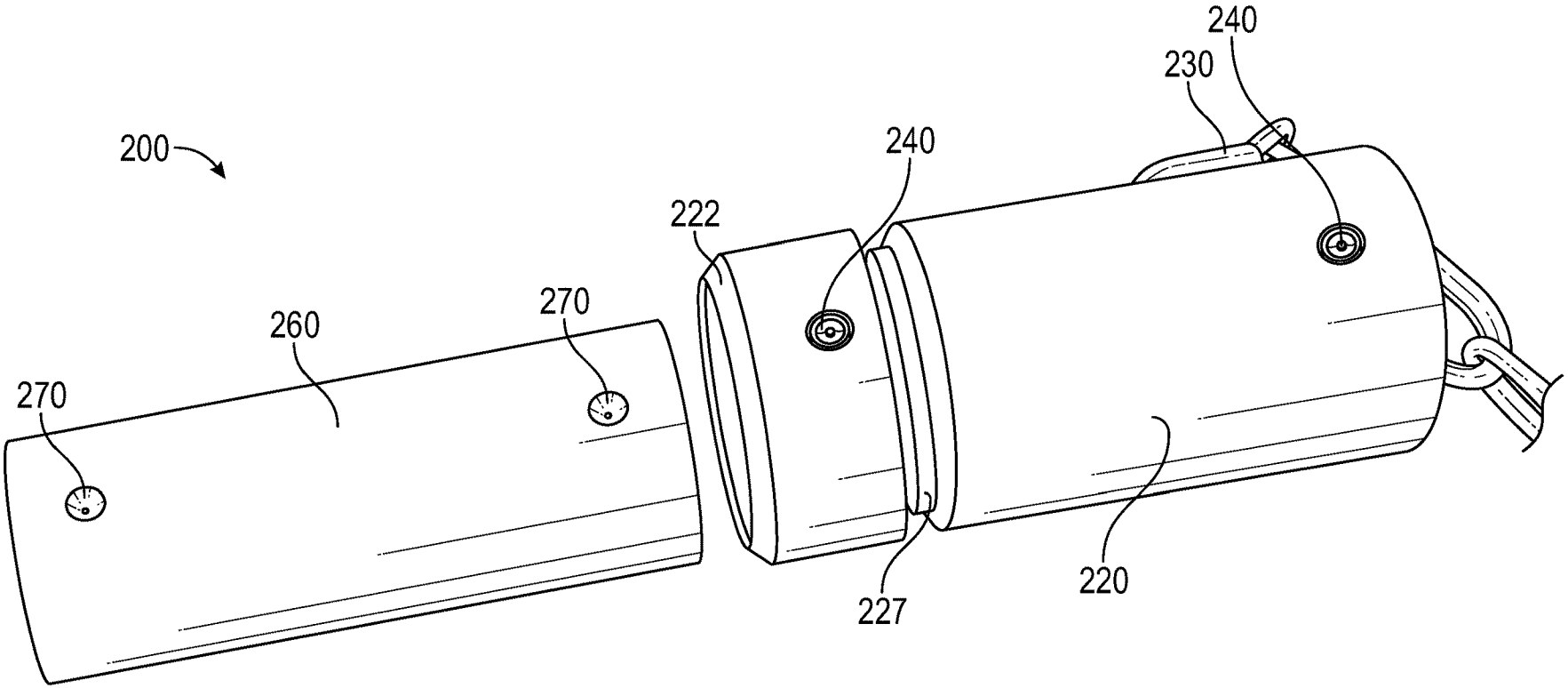
FIG. 10 depicts components of a disclosed slider assembly

FIG. 10 depicts components of the slider assembly 200.

Figure 11:
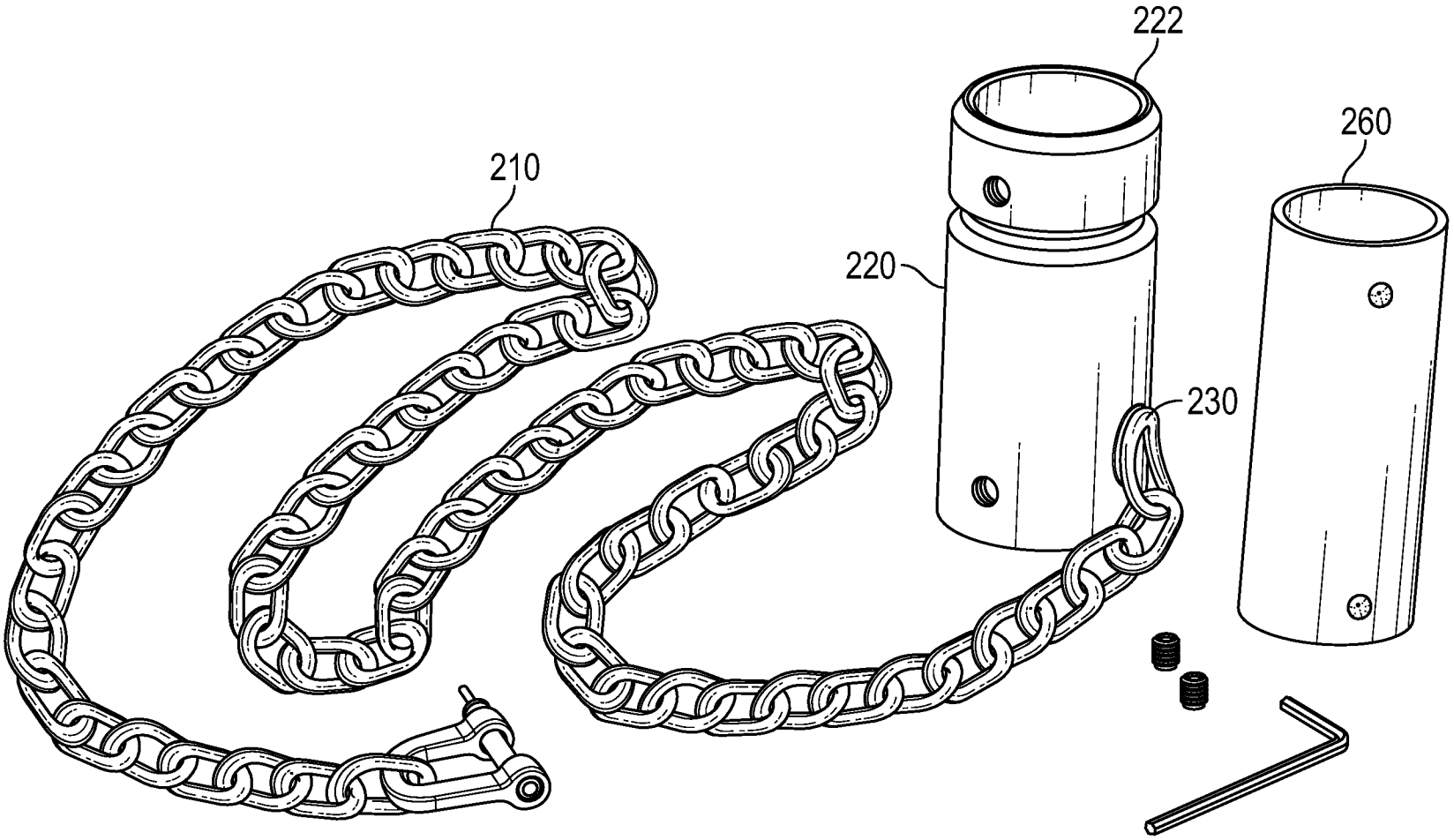
FIG. 11 depicts components of a disclosed slider assembly

FIG. 11 depicts components of the slider assembly 200.

Figure 12:
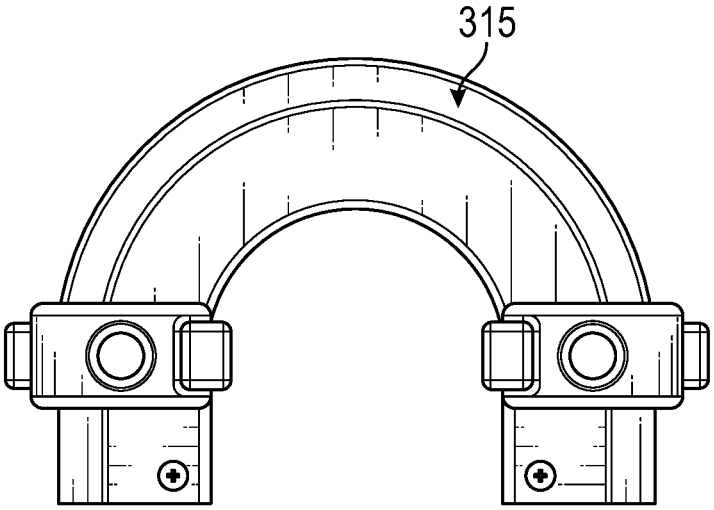
FIG. 12 depicts top view of a retriever

FIG. 12 depicts a top view of a retriever 315.

Figure 13:
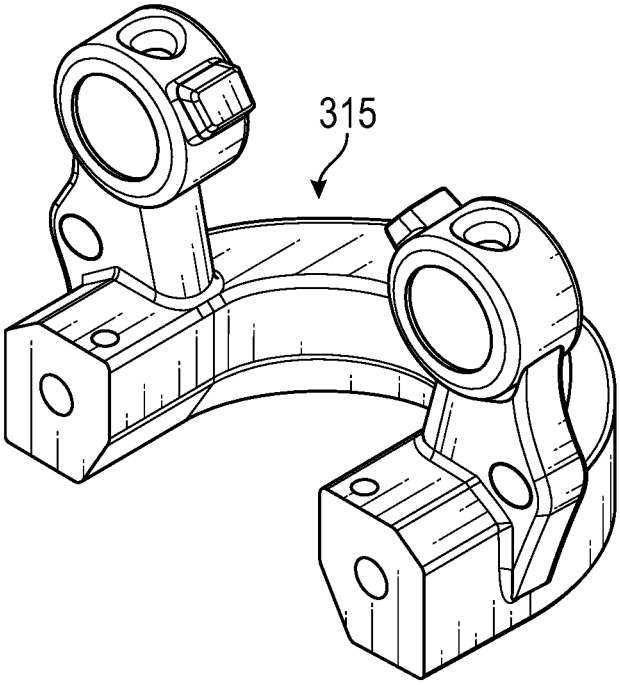
FIG. 13 depicts a perspective view of a retriever

FIG. 13 depicts a perspective view of a retriever 315.

Figure 14:
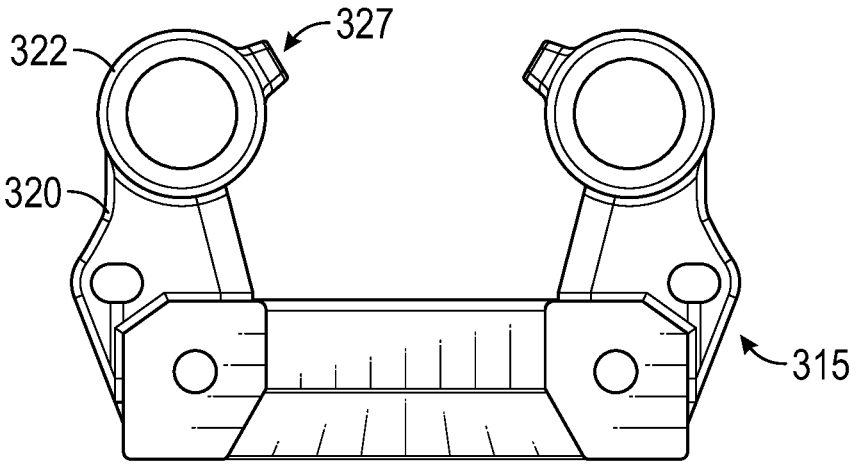
FIG. 14 depicts a side view of a retriever

FIG. 14 depicts a side view of a retriever 315 having two ring brackets 320, with each ring bracket supporting a rope ring 322 with each rope ring attached to a slider retention tab 327.

Figure 15:
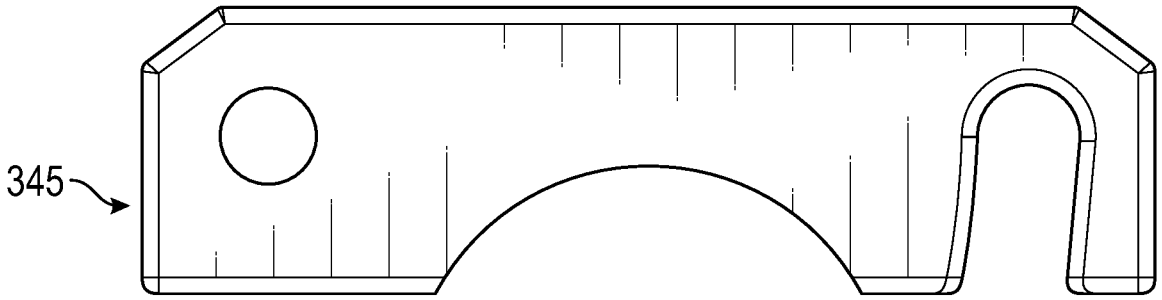
FIG. 15 depicts a side view of a gate

FIG. 15 depicts a retriever gate 345 or thumbnail gate from a side view.

Figure 16:
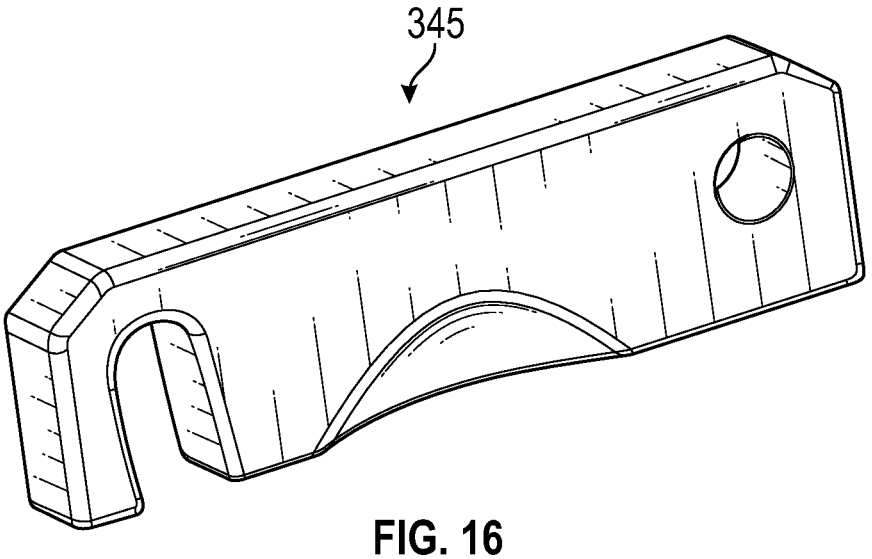
FIG. 16 depicts a perspective view of a gate

FIG. 16 is a perspective view a retriever gate 345.

Figure 17:
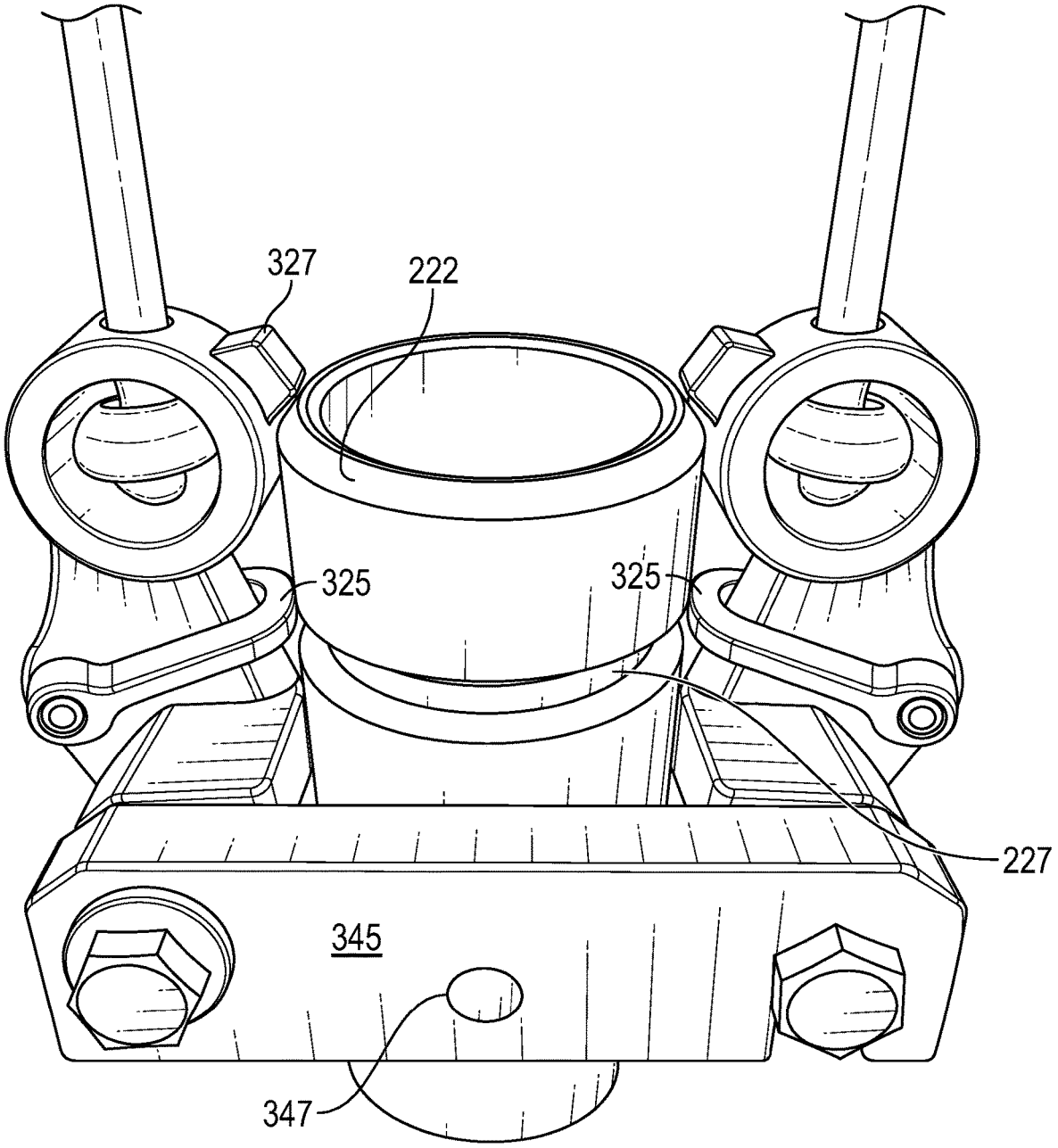
FIG. 17 depicts a slider assembly retained by a retriever assembly

FIG. 17 depicts a slider retention tab 327 in contact with a superior beveled edge 222 of a slider. The contact and retention properties of the two retention tabs 327 upon the superior beveled edge 222 of a slider are significant. The configuration, sometimes taken in conjunction with the floating shackles, provides a one way movement of the retriever assembly downwardly upon the slider assembly. The complementary angles of the retention tabs 327 and beveled edge allow for the retriever to move downwardly only and upon the subsequent lifting of the retriever by use of the two bridle lines, the retention tabs 327 and floating retriever shackles 325 trap, retain or otherwise secure the slider, causing tension upon the tether as the retriever pulls upwardly upon the slider.

Upon decent of the retriever around and upon the slider, the floating shackles stay in a downward position. But, upon the hoisting of the slider, the floating shackles 325 retain the slider by frictional attachment or insertion into a circular retention void 227 defined within the slider.

The sleeve insert 260 that my define an axial void may be inserted though an axial void defined by the slider. The use of an sleeve within the slider overcomes shortfalls in the prior art by allowing for sliders of different sizes to be used. Also the sleeve insert provides an extra barrier or level of protection from the anchor line or rode line that may be disposed within the axial void of the slider. Thus, the anchor line or rode line may be disposed within the axial void of the sleeve with the sleeved attached within the axial void of the slider. Thus friction or debris from the anchor line will be less likely to damage the slider.

The floating shackles and retention tabs of the retriever taken in conjunction with the circular retention void and superior beveled edge of the slider overcome the shortfalls in the prior art, including versions that use spring pins in the retriever that insert into the slider. The known prior art fails to come close to the efficacy of the disclosed embodiments.

What is claimed is:

1. An anchor rescue system (100) comprising:

a) a tether (210) comprising a first end attached to bottom portion of an anchor, the tether having a second end attached to an outer side of a slider (220);

b) the slider comprising a superior beveled edge (222) and a plurality of set screws (240) and the slider defining a center void, with the center void containing a sleeve insert (260) the sleeve insert defining a plurality of set screw divots (270), the sleeve insert retained within the slider by frictional attachment of the set screws upon the set screw divots, the slider further defining a circular retention void (227);

c) a retriever assembly (300) comprising a plurality of floating retriever shackles (325) contained within the circular retention void of the slider; the floating retriever shackles pivotally attached within voids defined by a retriever (315); the retriever further comprising two ring brackets (320) with each ring bracket attached to a rope ring (322) with each rope ring attached to a slider retention tab (327); the retriever further including a retriever gate (345).

2. The system of claim 1 further including frictional restraint between the slider retention tabs and the superior beveled edge of the slider.

3. The system of claim 1 further comprising a bridle line (310) with a first end attached to one of the rope rings and a second end attached to an opposite rope ring.

4. The system of claim 1 wherein the first end of the tether is attached to a crown eye void (425), the crown eye void defined within a crown end (440) of an anchor shank.

5. The system of claim 1 further including a plurality of Velcro ties (215) used to attach the tether to an anchor shank (410) of the anchor.

6. The system of claim 1 with anchor line disposed through an axial void of the slider sleeve.

* * * * *